US012013147B2

(12) United States Patent
Guo et al.

(10) Patent No.: US 12,013,147 B2
(45) Date of Patent: Jun. 18, 2024

(54) INDIRECT EVAPORATIVE COOLING AIR CONDITIONER

(71) Applicant: SHENZHEN ENVICOOL TECHNOLOGY CO., LTD., Shenzhen Guangdong (CN)

(72) Inventors: Shilong Guo, Shenzhen Guangdong (CN); Baokun Guo, Shenzhen Guangdong (CN); Wei Li, Shenzhen Guangdong (CN); Zhiqiang Cai, Shenzhen Guangdong (CN)

(73) Assignee: SHENZHEN ENVICOOL TECHNOLOGY CO., LTD., Guangdong (CN)

( * ) Notice: Subject to any disclaimer, the term of this patent is extended or adjusted under 35 U.S.C. 154(b) by 88 days.

(21) Appl. No.: 17/827,981

(22) Filed: May 30, 2022

(65) Prior Publication Data

US 2022/0381455 A1 Dec. 1, 2022

(30) Foreign Application Priority Data

Jun. 1, 2021 (CN) ..... 202121217207.6

(51) Int. Cl.
*F24F 5/00* (2006.01)
*F24F 6/14* (2006.01)
(Continued)

(52) U.S. Cl.
CPC ..... *F24F 5/0035* (2013.01); *F24F 6/14* (2013.01); *F24F 13/20* (2013.01); *F24F 13/30* (2013.01)

(58) Field of Classification Search
CPC .. F24F 5/0035; F24F 6/14; F24F 13/20; F24F 13/30; F28D 1/0426; F28D 9/00;
(Continued)

(56) References Cited

U.S. PATENT DOCUMENTS

2006/0130508 A1* 6/2006 Liu ..... F24F 3/147 62/271
2007/0101746 A1 5/2007 Schlom et al.
(Continued)

FOREIGN PATENT DOCUMENTS

JP 5814844 B2 * 11/2015
KR 200429518 Y1 * 10/2006
(Continued)

OTHER PUBLICATIONS

Search Report dated Sep. 16, 2022 for European patent application No. 22166039.2.

*Primary Examiner* — Kun Kai Ma
(74) *Attorney, Agent, or Firm* — Yue(Robert) Xu; Apex Attorneys at Law, LLP

(57) ABSTRACT

An indirect evaporative cooling air conditioner is provided, which includes a housing, multiple partition plates located in the housing and at least two heat exchangers arranged side by side. The multiple partition plates and the at least two heat exchangers separate the housing into multiple indoor air flow passages and multiple outdoor air flow passages, each heat exchange has a first heat exchange flow passage and a second heat exchange flow passage crosswise and independently arranged, the indoor air flow passages are in communication with the first heat exchange flow passages to form an indoor circulation passage, the outdoor air flow passages are in communication with the second heat exchange flow passages to form an outdoor circulation passage, and the fluid in the indoor circulation passages exchange heat with the fluid in the outdoor circulation passages through the at least two heat exchangers.

13 Claims, 11 Drawing Sheets

(51) Int. Cl.
*F24F 13/20* (2006.01)
*F24F 13/30* (2006.01)

(58) Field of Classification Search
CPC ..... F28D 2001/0266; F28D 5/00; F28D 5/02; F28D 21/0014; F28F 2250/106
See application file for complete search history.

(56) References Cited

U.S. PATENT DOCUMENTS

| | | | | |
|---|---|---|---|---|
| 2018/0245815 | A1* | 8/2018 | Lee | F24F 11/30 |
| 2019/0124796 | A1 | 4/2019 | Lin | |

FOREIGN PATENT DOCUMENTS

| | | | | |
|---|---|---|---|---|
| KR | 20080013585 | A | * | 2/2008 |
| KR | 101115314 | B1 | * | 3/2012 |
| KR | 101717773 | B1 | * | 3/2017 |
| WO | 2016/055759 | A1 | | 4/2016 |
| WO | WO-2018173277 | A1 | * | 9/2018 |

* cited by examiner

INDIRECT EVAPORATIVE COOLING AIR CONDITIONER

CROSS REFERENCE TO RELATED APPLICATIONS

This application claims the priority to Chinese Patent Application No. 202121217207.6 titled "INDIRECT EVAPORATIVE COOLING AIR CONDITIONER", filed with the China National Intellectual Property Administration on Jun. 1, 2021, which is incorporated herein by reference in its entirety.

FIELD

The present application relates to the technical field of air conditioning technology, and in particular to an indirect evaporative cooling air conditioner.

BACKGROUND

With the national advocacy of energy conservation and emission reduction, more and more attention has been paid to the concept of green data center, and evaporative cooling technology has been spread and applied to the field of computer room air conditioning, to use outdoor air and a heat exchanger to perform heat exchange, so as to cool the computer room, which makes full use of natural clean energy. Indirect evaporative cooling is a unique iso-humidity cooling manner of evaporative cooling, the basic principle of which is to use the air after direct evaporative cooling (called secondary air) and water to exchange heat with outdoor air through a heat exchanger, so as to achieve fresh air (called primary air) cooling. Since air does not directly contact with water, its moisture content remains unchanged, and a change process of the primary air is an iso-humidity cooling process. With this technology, cooling capacity can be obtained from the natural environment, which can save 80% to 90% of energy in a hot and dry area, 20% to 25% of energy in a hot and humid area, and 40% in a moderate humidity area compared with general conventional mechanical refrigeration, thereby greatly reducing the energy consumption of air conditioning refrigeration.

However, the existing indirect evaporative cooling air conditioner has complex airflow pattern, large local resistance, and low energy efficiency ratio.

Therefore, a technical problem to be addressed by those skilled in the art is to reduce the resistance of the system, improve the efficiency of the heat exchanger and improve the energy efficiency ratio of the air conditioner.

SUMMARY

In view of this, an indirect evaporative cooling air conditioner is provided according to the present application, to reduce the resistance of a system and improve the efficiency of a heat exchanger.

In order to achieve the above objects, the following technical solutions are provided according to the present application.

An indirect evaporative cooling air conditioner includes a housing, multiple partition plates located in the housing and at least two heat exchangers arranged side by side, the multiple partition plates and the at least two heat exchangers separate the housing into multiple indoor air flow passages and multiple outdoor air flow passages, each of the heat exchangers has a first heat exchange flow passage and a second heat exchange flow passage which are crosswise and independently arranged with respect to each other, the multiple indoor air flow passages are in communication with the first heat exchange flow passage to form an indoor circulation passage, the multiple outdoor air flow passages are in communication with the second heat exchange flow passage to form an outdoor circulation passage, and heat exchange between a fluid in the indoor circulation passage and a fluid in the outdoor circulation passage is performed by the at least two heat exchangers.

In an embodiment, outlets or inlets of the first heat exchange passages of two adjacent heat exchangers of the at least two heat exchangers are in communication with a same indoor air flow passage of the multiple indoor air flow passages, and inlets or outlets of the second heat exchange passages of the two adjacent heat exchangers are in communication with a same outdoor air flow passage of the multiple outdoor air flow passages.

In an embodiment, the multiple outdoor air flow passages include a first outdoor air flow passage and a second outdoor air flow passage, the multiple indoor air flow passages include a first indoor air flow passage and a second indoor air flow passage; the first outdoor air flow passage, the second outdoor air flow passage, the first indoor air flow passage and the second indoor air flow passage are distributed to peripherally surround the at least two heat exchangers; the first indoor air flow passage and the second indoor air flow passage are respectively in communication with inlets and outlets of the first heat exchange flow passages, and the first outdoor air flow passage and the second outdoor air flow passage are respectively in communication with inlets and outlets of the second heat exchange flow passages.

In an embodiment, at least one of the multiple outdoor air flow passages is provided with a spray member.

In an embodiment, the spray member is a water sprayer, and the water sprayer is arranged in an outdoor air flow passage, located at an inlet side and/or an outlet side of the second heat exchange flow passage, of the multiple outdoor air flow passages.

In an embodiment, the spray member is a mist sprayer, and the mist sprayer is arranged in an outdoor air flow passage, located at an inlet side of the second heat exchange flow passage.

In an embodiment, the indirect evaporative cooling air conditioner according to the present application further includes a compression refrigeration cycle system, the compression refrigeration cycle system includes an evaporator, and the evaporator is arranged in the indoor circulation passage and located downstream of the at least two heat exchangers.

In an embodiment, the indirect evaporative cooling air conditioner according to the present application further includes a compression refrigeration cycle system, the compression refrigeration cycle system includes a condenser, and the condenser is arranged in the outdoor circulation passage and located downstream of the at least two heat exchangers.

In an embodiment, two heat exchangers are provided, the two heat exchangers, the multiple indoor air flow passages and the multiple outdoor air flow passages are respectively distributed in the housing in an axisymmetrical manner.

In an embodiment, the housing is an one-piece housing, the one-piece housing, the at least two heat exchangers and the multiple partition plates which are arranged inside the housing form an integrated unit; or, the housing includes multiple independent housings, one of the at least two heat exchangers and a part of the multiple partition plates are provided inside each of the multiple independent housings; the independent housing, the heat exchanger and the part of the plurality of partition plates which are arranged inside the independent housing form an independent unit, and the indirect evaporative cooling air conditioner is formed by at least two independent units assembled to each other.

In an embodiment, two adjacent heat exchangers are directly connected or connected through one of the multiple partition plates.

In an embodiment, a sectional shape of each of the at least two heat exchangers is any one of a triangle, a quadrilateral, a pentagon, and a hexagon.

In an embodiment, at least one of the multiple partition plates is a straight plate arranged obliquely or vertically relative to, or in parallel with a side wall of the housing; or at least one of the multiple partition plates is a bent plate.

In an embodiment, a mounting angle of each of the at least two heat exchangers in the housing ranges from 0 degree to 360 degrees.

The indirect evaporative cooling air conditioner according to the present application includes the housing, the multiple partition plates located in the housing and the at least two heat exchangers arranged side by side, the multiple partition plates and the at least two heat exchangers separate the housing into the multiple indoor air flow passages and the multiple outdoor air flow passages, each of the heat exchangers has the first heat exchange flow passage and the second heat exchange flow passage which are crosswise and independently arranged with respect to each other, the multiple indoor air flow passages are in communication with the first heat exchange flow passages to form the indoor circulation passage, the multiple outdoor air flow passages are in communication with the second heat exchange flow passages to form the outdoor circulation passage, and heat exchange between the fluid in the indoor circulation passage and the fluid in the outdoor circulation passage is performed by the at least two heat exchangers.

Since at least two heat exchangers are arranged side by side in the air conditioner in this solution, provided that the core body volume of the heat exchanger is unchanged, a windward heat exchange area in the first or second heat exchange flow passage can be increased, and an air flow resistance is reduced. In addition, the heat exchangers arranged side by side increase a heat exchange temperature difference between the first heat exchanger flow passage and the second heat exchanger flow passage, so that heat exchange efficiency is increased, and an energy efficiency ratio of the air conditioner is improved.

BRIEF DESCRIPTION OF THE DRAWINGS

For more clearly illustrating embodiments of the present application or the technical solutions in the conventional technology, drawings referred to for describing the embodiments or the conventional technology will be briefly described hereinafter. Apparently, drawings in the following description are only examples of the present application, and for the person skilled in the art, other drawings may be obtained based on the provided drawings without any creative efforts.

Figure 1:
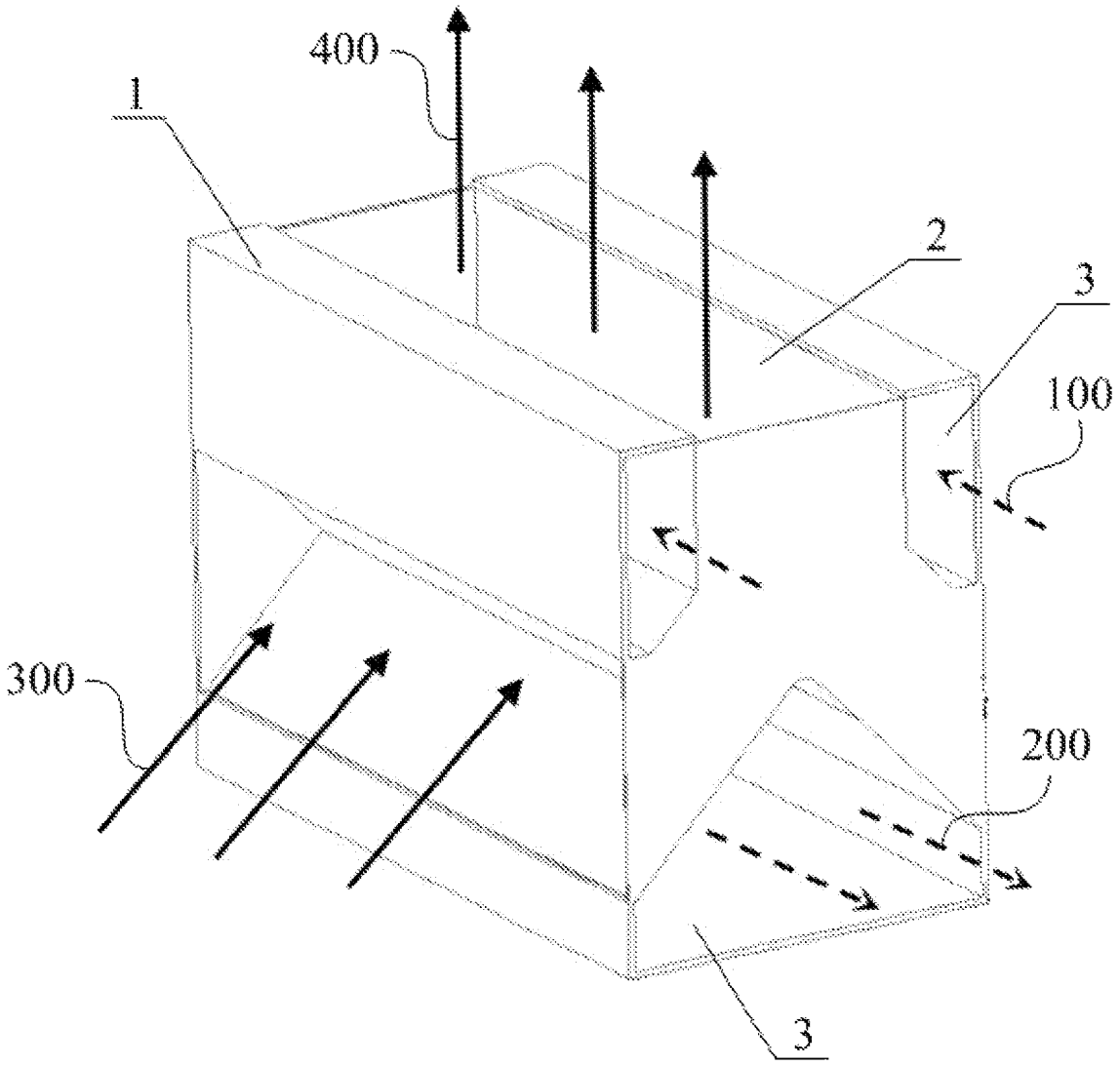
FIG. 1 is a three-dimensional schematic view showing flowing of airflow in an indirect evaporative cooling air conditioner according to a specific embodiment of the present application.

Reference numerals in FIGS. 1 to 14 are as follows:

| | | | |
|---|---|---|---|
| 1 | housing, | 2 | outdoor air flow passage, |
| 3 | indoor air flow passage, | 4 | heat exchanger, |
| 5 | partition plate, | 100 | indoor return air, |
| 200 | indoor air supply, | 300 | to-be-introduced outdoor air, |
| 400 | to-be-discharged outdoor air, | 21 | first outdoor air flow passage, |
| 22 | second outdoor air flow passage, | 31 | first indoor air flow passage, |
| 32 | second indoor air flow passage, | 11 | first independent housing, |
| 12 | second independent housing, | 6 | spray member, |
| 7 | condenser, | 8 | evaporator. |

DETAILED DESCRIPTION OF THE EMBODIMENTS

The technical solutions according to the embodiments of the present application will be described clearly and completely as follows in conjunction with the drawings in the embodiments of the present application. It is apparent that the described embodiments are only a part of the embodiments according to the present application, rather than all of the embodiments. Based on the embodiments of the present application, all of other embodiments, made by the person skilled in the art without any creative efforts, fall into the scope of protection of the present application.

Figure 2:
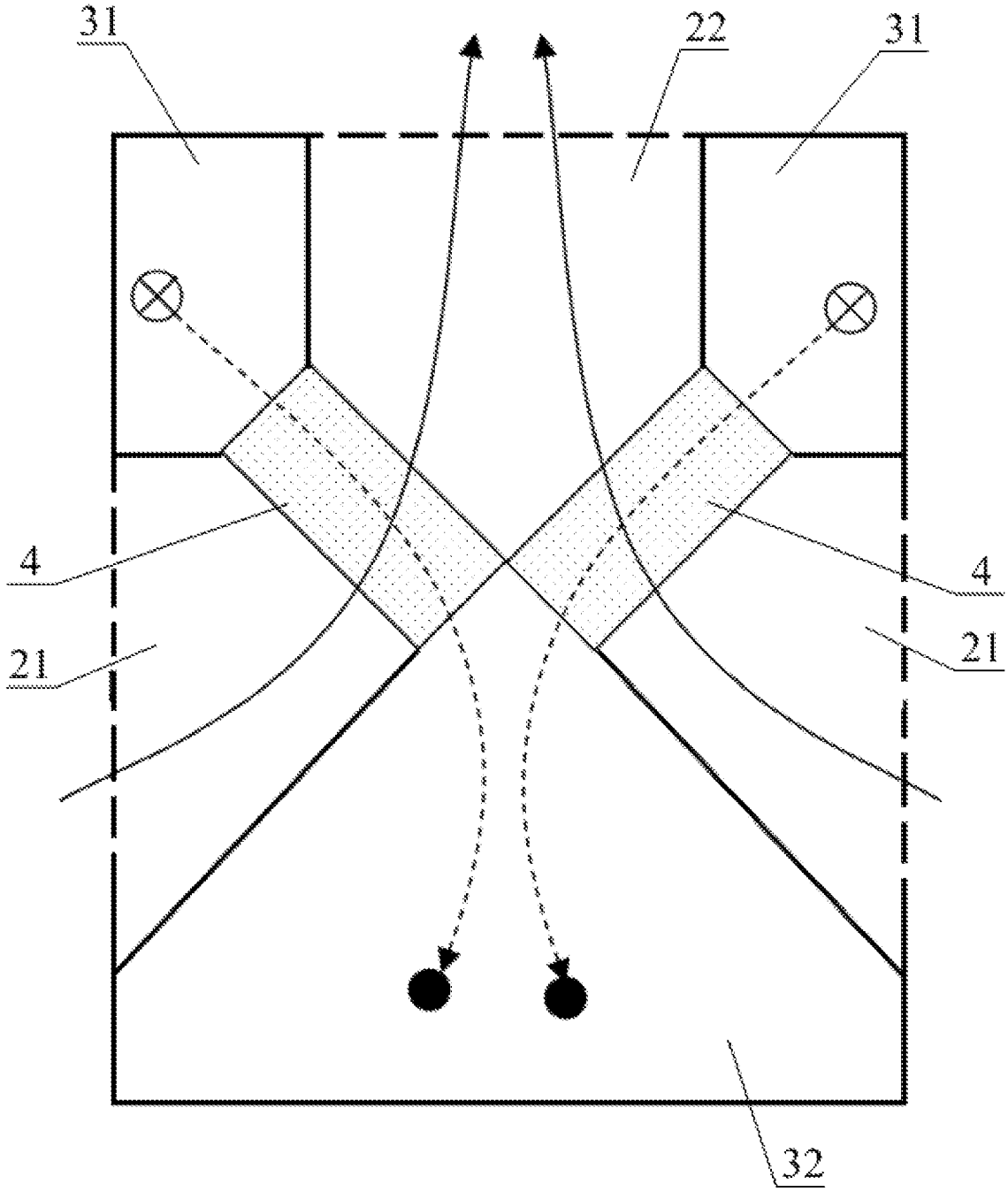
FIG. 2 is a two-dimensional schematic view showing the flowing of the airflow in the indirect evaporative cooling air conditioner according to the specific embodiment of the present application.
Figure 7:
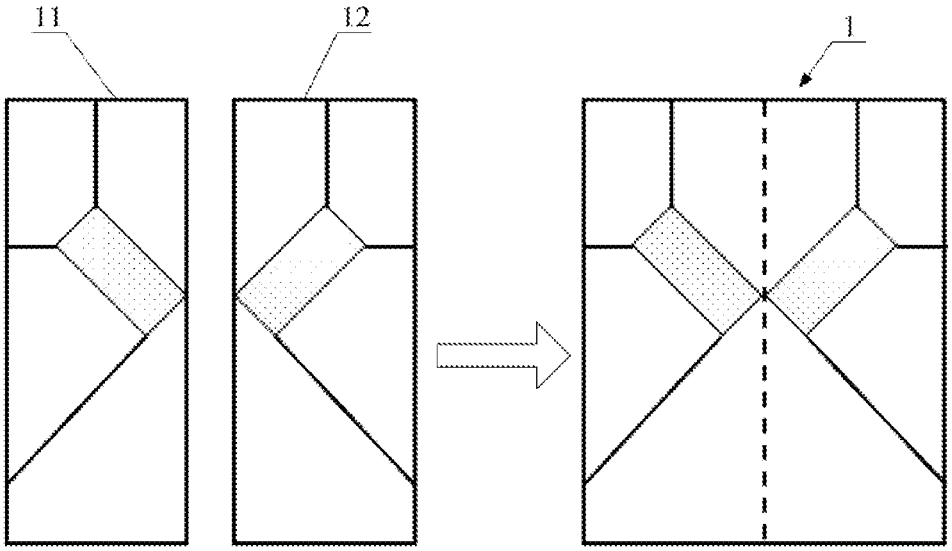
FIG. 7 is a schematic view showing an assembly of two independent units according to the specific embodiment of the present application.
Figure 8:
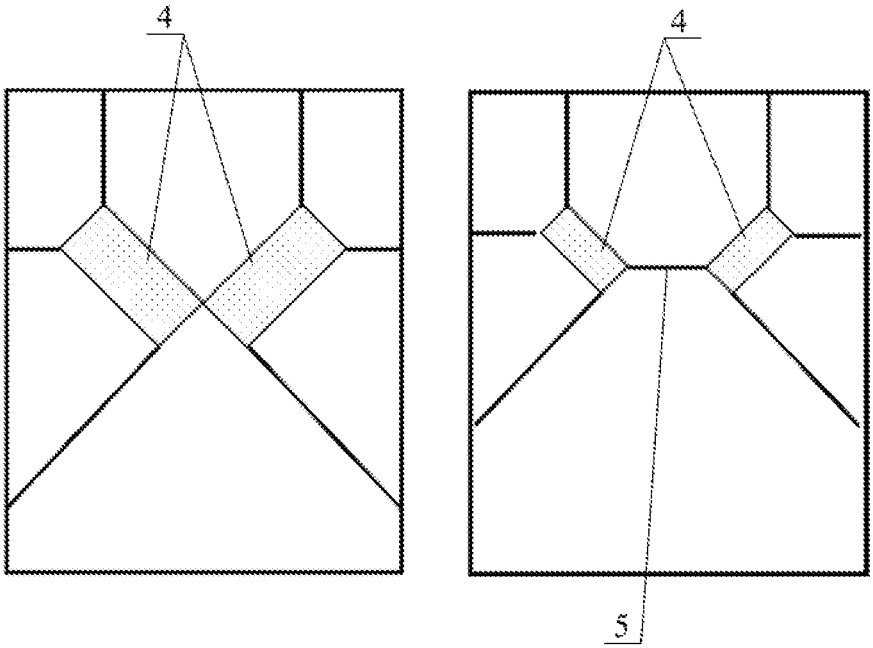
FIG. 8 is a schematic view showing comparison of different sizes of heat exchangers according to specific embodiments of the present application.
Figure 9:
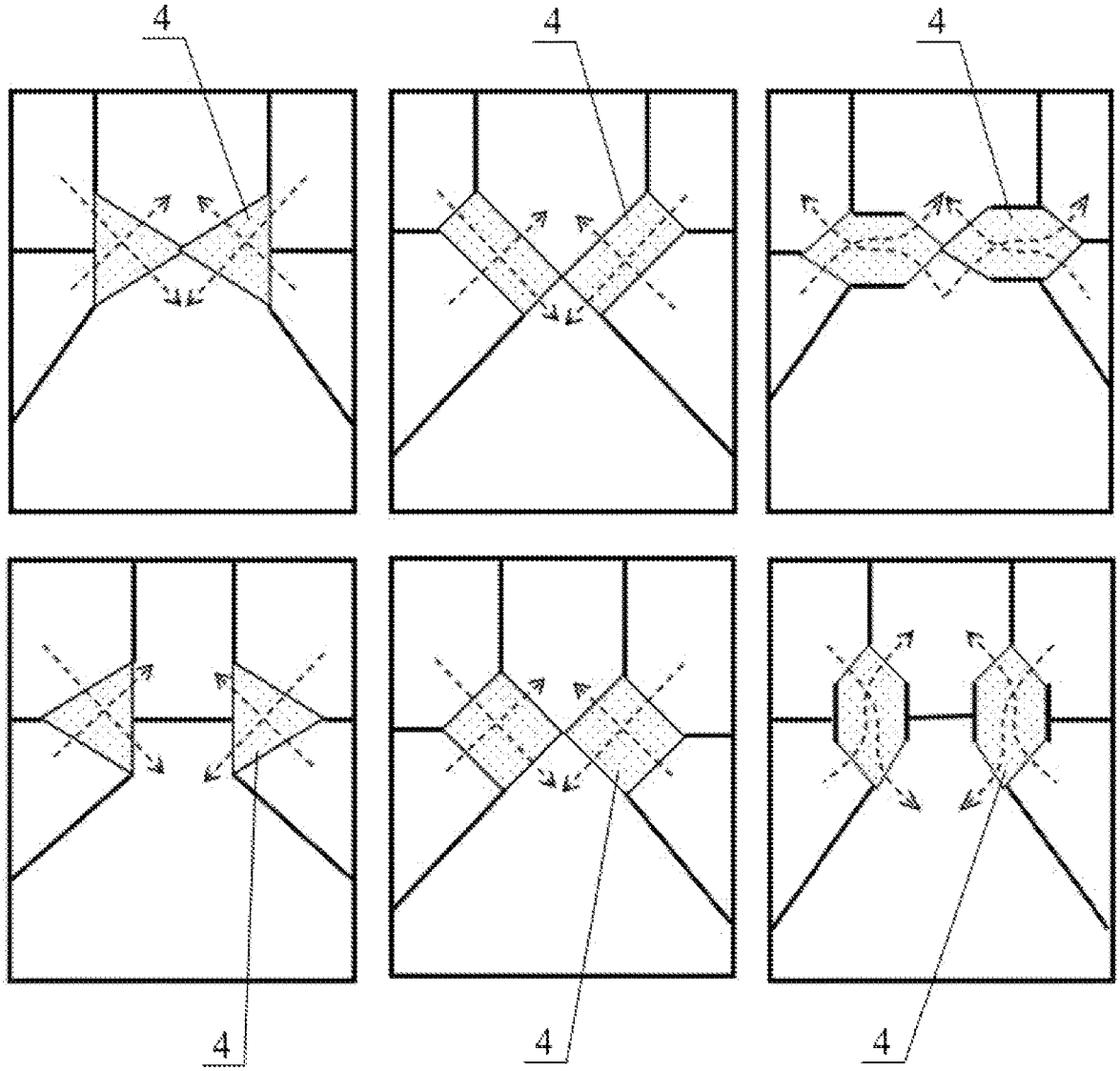
FIG. 9 is a schematic view showing different shapes of heat exchangers according to specific embodiments of the present application.
Figure 10:
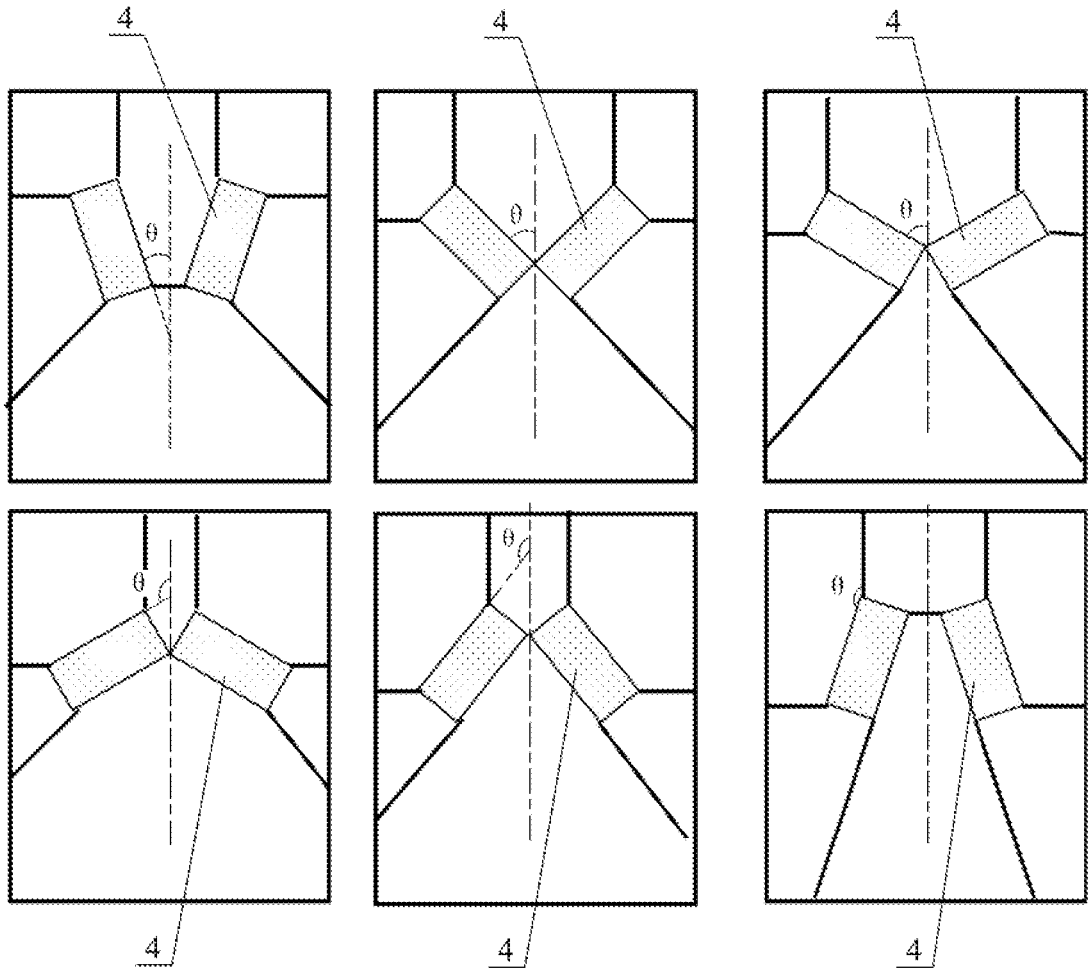
FIG. 10 is a schematic view showing different mounting angles of the heat exchangers according to the specific embodiments of the present application.
Figure 11:
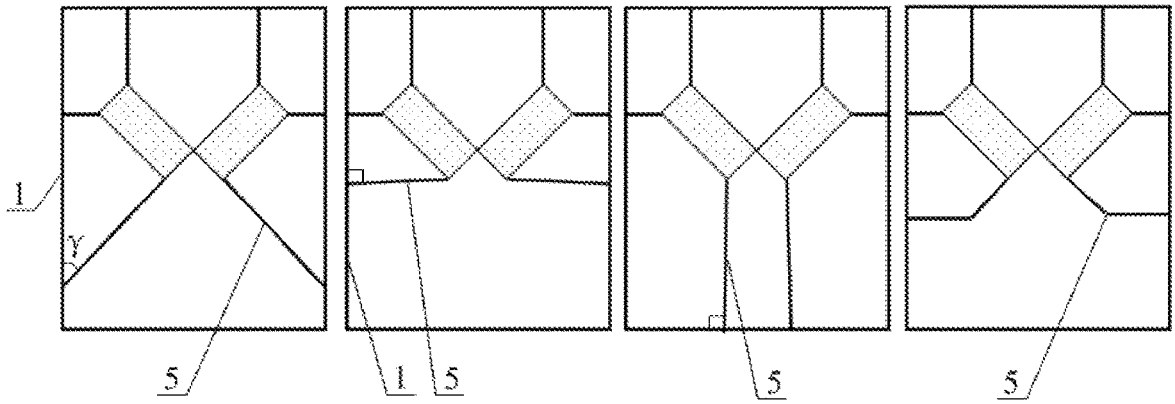
FIG. 11 is a schematic view showing different arrangement manners of partition plates according to the specific embodiments of the present application.
Figure 12:
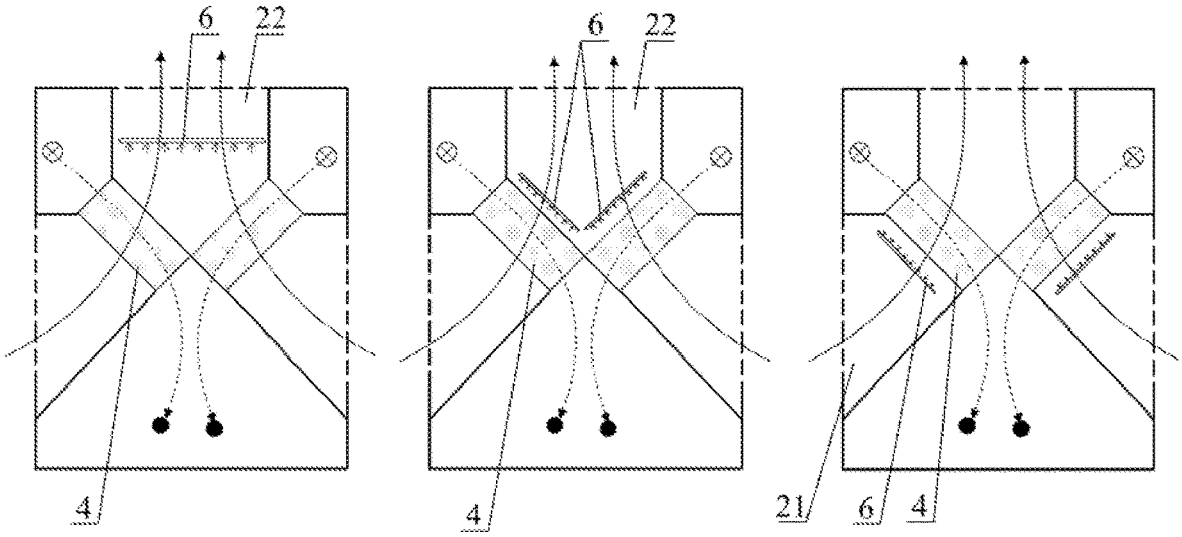
FIG. 12 is a schematic view showing different arrangement manners of spray members according to the specific embodiments of the present application.
Figure 13:
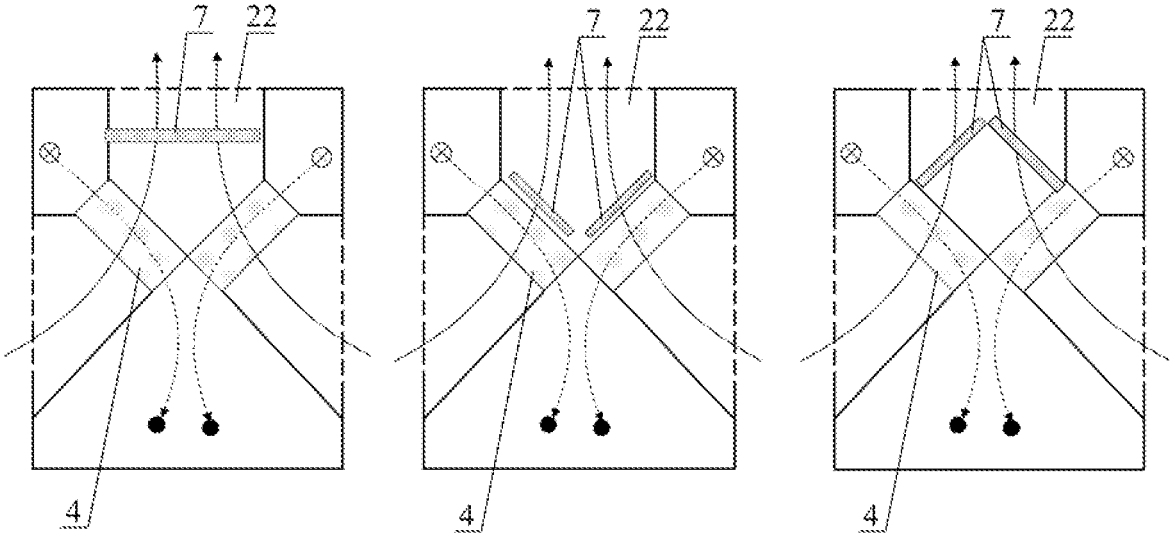
FIG. 13 is a schematic view showing different arrangement manners of condensers according to the specific embodiments of the present application.
Figure 14:
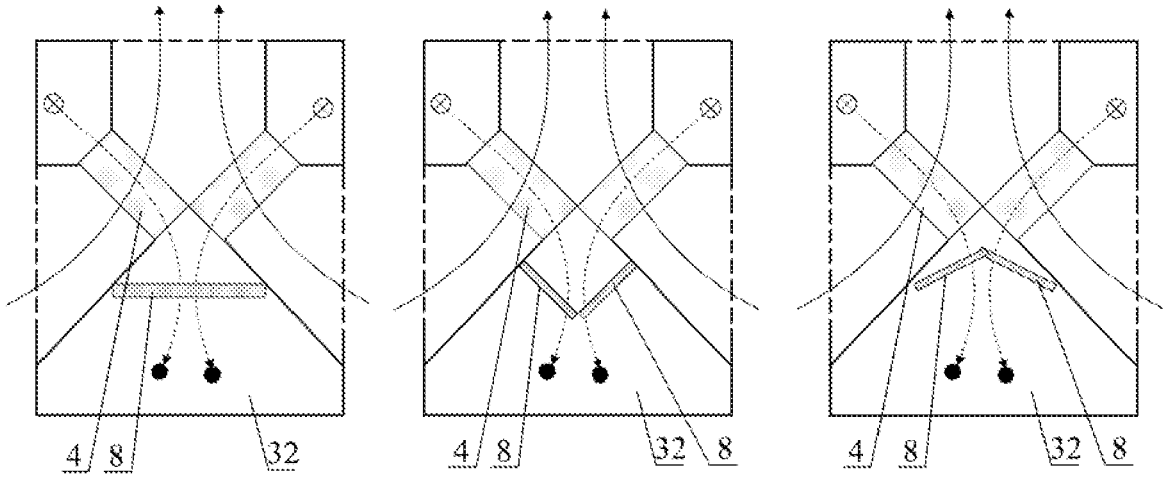
FIG. 14 is a schematic view showing different arrangement manners of evaporators according to the specific embodiment of the present application.

Referring to FIGS. 1 to 14, FIG. 1 is a three-dimensional schematic view showing flowing of airflow in an indirect evaporative cooling air conditioner according to a specific embodiment of the present application; FIG. 2 is a two-dimensional schematic view showing the flowing of the airflow in the indirect evaporative cooling air conditioner according to the specific embodiment of the present application; FIGS. 3 to 6 are schematic views respectively showing a first airflow pattern to a fourth airflow pattern in the indirect evaporative cooling air conditioner according to the specific embodiment of the present application; FIG. 7 is a schematic view showing an assembly of two independent units according to the specific embodiment of the present application; FIG. 8 is a schematic view showing comparison of different sizes of heat exchangers according to specific embodiments of the present application; FIG. 9 is a schematic view showing different shapes of heat exchangers according to specific embodiments of the present application; FIG. 10 is a schematic view showing different mounting angles of the heat exchangers according to the specific embodiments of the present application; FIG. 11 is a schematic view showing different arrangement manners of partition plates according to the specific embodiments of the present application; FIG. 12 is a schematic view showing different arrangement manners of spray members according to the specific embodiments of the present application; FIG. 13 is a schematic view showing different arrangement manners of condensers according to the specific embodiments of the present application; and FIG. 14 is a schematic view showing different arrangement manners of evaporators according to the specific embodiments of the present application.

An indirect evaporative cooling air conditioner according to the present application includes a housing 1, multiple partition plates 5 located in the housing 1 and at least two heat exchangers 4 arranged side by side, the multiple partition plates 5 and the at least two heat exchangers 4 separate the housing 1 into multiple indoor air flow passages 3 and multiple outdoor air flow passages 2, each heat exchanger 4 has a first heat exchange flow passage and a second heat exchange flow passage which are crosswise and independently arranged, the multiple indoor air flow passages 3 are in communication with the first heat exchange flow passage to form an indoor circulation passage, the multiple outdoor air flow passages 2 are in communication with the second heat exchange flow passage to form an outdoor circulation passage, and heat exchange between a fluid in the indoor circulation passage and a fluid in the outdoor circulation passage is performed by the at least two heat exchangers 4.

In this solution, since at least two heat exchangers 4 arranged side by side are provided in the air conditioner, provided that a core body volume is unchanged, a windward heat exchange area of the first or second heat exchange flow passage in the heat exchanger can be increased, and an air flow resistance is reduced. In addition, the heat exchangers arranged side by side increase a heat exchange temperature difference between the first heat exchanger flow passage and the second heat exchanger flow passage, thus the heat exchange efficiency is increased, and the energy efficiency ratio of the air conditioner is improved.

In an embodiment, outlets or inlets of the first heat exchange passages of two adjacent heat exchangers 4 are in communication with a same indoor air flow passage 3 of the multiple indoor air flow passages, and inlets or outlets of the second heat exchange passages of two adjacent heat exchangers 4 are in communication with a same outdoor air flow passage 2 of the multiple indoor air flow passages. Such arrangement can ensure that airflow can circulate through the first heat exchange passages of the two adjacent heat exchangers 4 and the same indoor air flow passage 3, and airflow can circulate through the second heat exchange passages of the two heat exchangers 4 and the same outdoor air flow passage 2, which further simplifies the airflow pattern in a unit.

It should be noted that two or more heat exchangers 4 can be arranged side by side in one air conditioner. In a solution, two heat exchangers 4 are provided, the two heat exchangers 4, the multiple indoor air flow passages 3 and the multiple outdoor air flow passages 2 are respectively distributed in the housing 1 in an axisymmetrical manner.

In an embodiment, the multiple outdoor air flow passages 2 include a first outdoor air flow passage 21 and a second outdoor air flow passage 22, the multiple indoor air flow passages 3 includes a first indoor air flow passage 31 and a second indoor air flow passage 32, the first outdoor air flow passage 21, the second outdoor air flow passage 22, the first indoor air flow passage 31 and the second indoor air flow passage 32 are distributed to peripherally surround the at least two heat exchangers 4. The first indoor air flow passage 31 and the second indoor air flow passage 32 are respectively in communication with inlets and outlets of the first heat exchange flow passages, and the first outdoor air flow passage 21 and the second outdoor air flow passage 22 are respectively in communication with inlets and outlets of the second heat exchange flow passages. The first indoor air flow passage 31 may be multiple, and the first outdoor air flow passage 21 may be multiple. In the embodiment shown in FIG. 2, two first indoor air flow passages 31 and two first outdoor air flow passages 21 are provided. The two first indoor air flow passages 31 are in one-to-one correspondence with the inlets of the first heat exchange flow passages, and the two first outdoor air flow passages 21 are in one-to-one correspondence with the inlets of the second heat exchange flow passages. As shown in FIG. 1 and FIG. 2, the dashed arrow represents indoor side airflow, and the solid arrow represents outdoor side airflow. Indoor return air 100 enters the unit through the two first indoor air flow passages 31, and becomes relatively low-temperature air after heat exchange with the outdoor side airflow in the two heat exchangers 4. Low-temperature indoor air supply 200 flows out of the unit from the second indoor air flow passage 32 to be sent to the indoor environment. To-be-introduced outdoor air 300 enters the unit through the two first outdoor air flow passages 21 located at two sides of the unit, the temperature of the introduced outdoor air rises after heat exchange with the indoor side airflow through the two heat exchangers 4, and to-be-discharged outdoor air 400 finally flows out of the unit through the second outdoor air flow passage 22.

It should be noted that, the outdoor air flow passages 2 and the indoor air flow passages 3 according to the present application may be arranged in various manners, which can form various airflow patterns. As shown in the cross-sectional schematic views of the air conditioner in FIGS. 3 to 6, four airflow patterns are respectively listed, in which the dashed arrow represents the indoor side airflow, and the solid arrow represents the outdoor side airflow.

Figure 3:
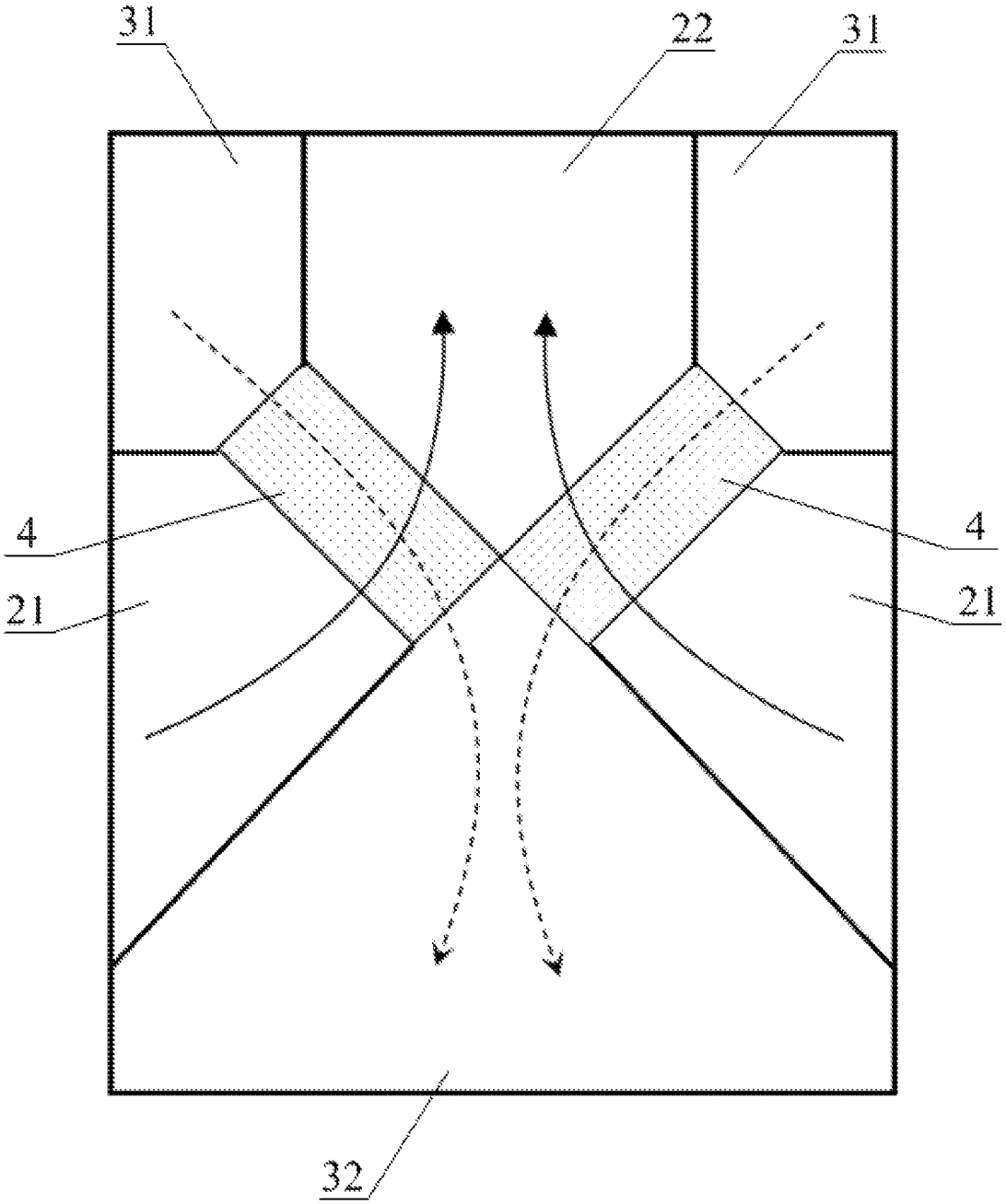
FIG. 3 is a schematic view showing a first airflow pattern in the indirect evaporative cooling air conditioner according to the specific embodiment of the present application.

As shown in FIG. 3, an indoor air returning port of the air conditioner may be arranged on a front end surface and/or a rear end surface and/or an upper surface and/or a left or a right side surface of the air conditioner, and an indoor air supply port may be arranged on the front end surface and/or the rear end surface and/or a lower surface and/or the left or the right side surface of the air conditioner. An outdoor air introducing port may be arranged on the front end surface and/or the rear end surface and/or the left or the right side surface of the air conditioner, and an outdoor air discharge port may be arranged on the front end surface and/or the rear end surface and/or the upper surface of the air conditioner.

Figure 4:
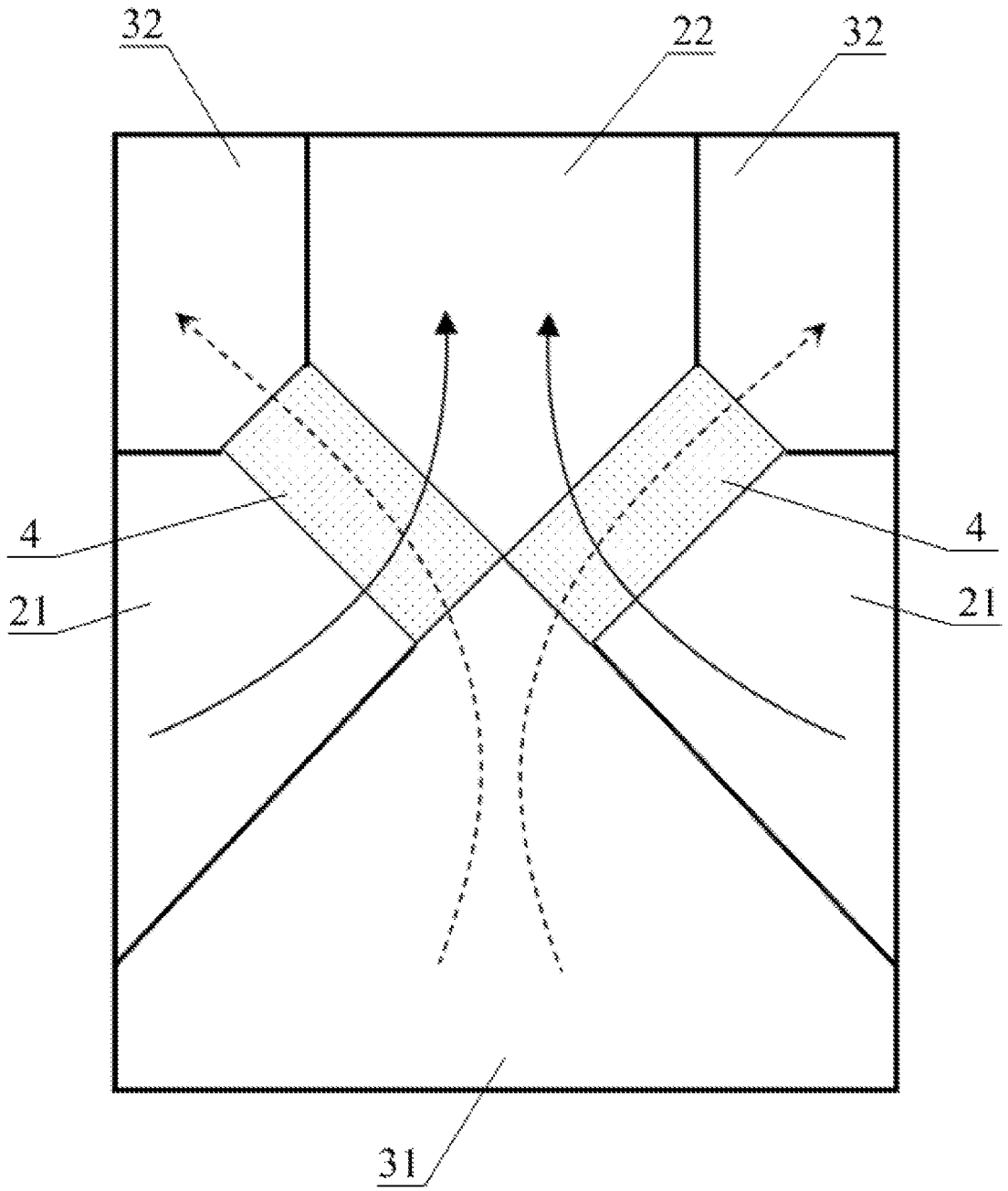
FIG. 4 is a schematic view showing a second airflow pattern in the indirect evaporative cooling air conditioner according to the specific embodiment of the present application.

As shown in FIG. 4, the indoor air returning port of the air conditioner may be arranged on the front end surface and/or the rear end surface and/or the lower surface and/or the left or the right side surface of the air conditioner, and the indoor air supply port may be arranged on the front end surface and/or the rear end surface and/or the upper end surface and/or the left or the right side surface of the air conditioner. The outdoor air introducing port may be arranged on the front end surface and/or the rear end surface and/or the left or the right side surface of the air conditioner, and the outdoor air discharge port may be arranged on the front end surface and/or the rear end surface and/or the upper surface of the air conditioner.

Figure 5:
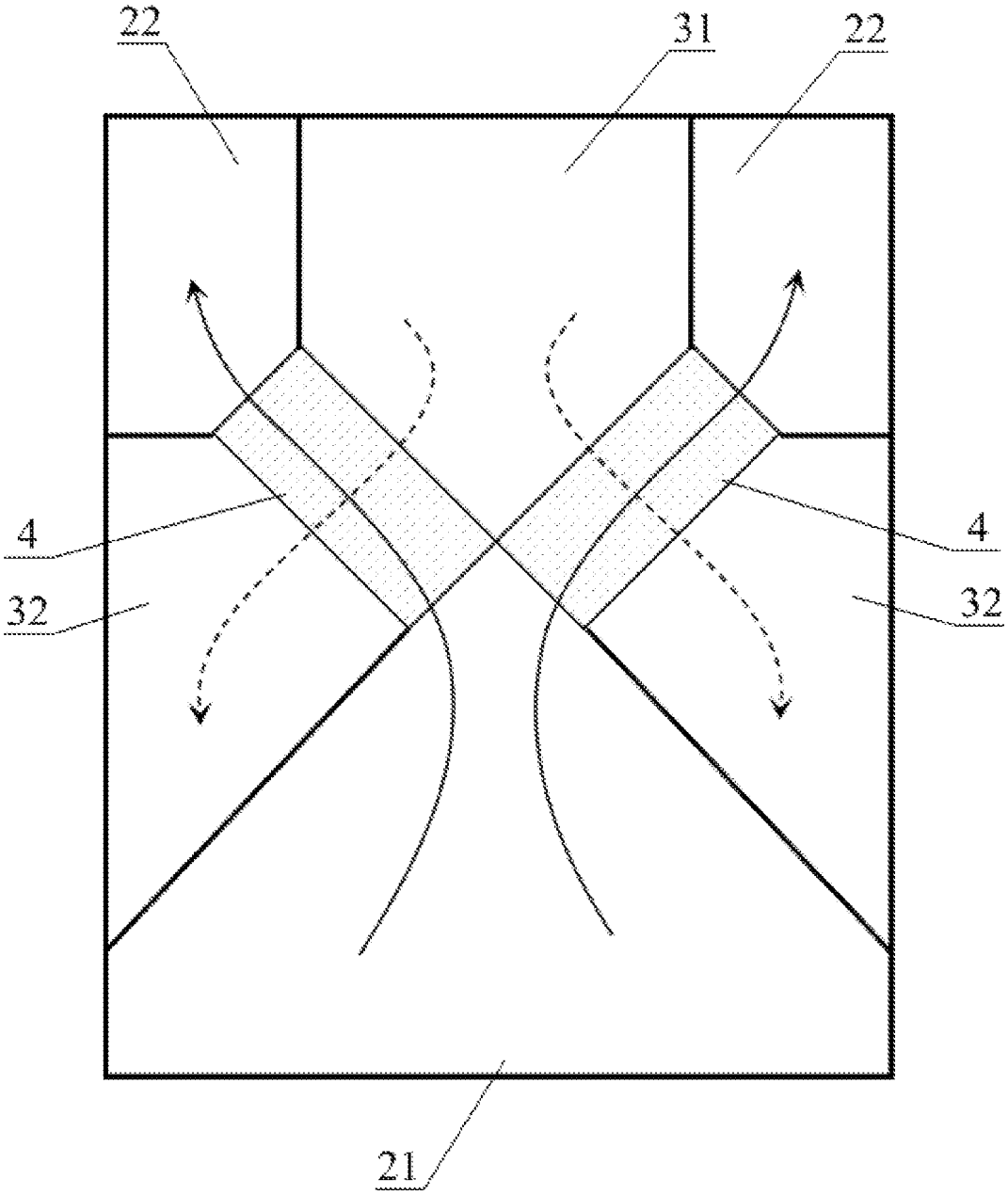
FIG. 5 is a schematic view showing a third airflow pattern in the indirect evaporative cooling air conditioner according to the specific embodiment of the present application.

As shown in FIG. 5, the indoor air returning port of the air conditioner may be arranged on the front end surface and/or the rear end surface and/or the upper surface of the air conditioner, and the indoor air supply port may be arranged on the front end surface and/or the rear end surface and/or the left or the right side surface of the air conditioner. The outdoor air introducing port of the air conditioner may be arranged on the front end surface and/or the rear end surface and/or the lower surface and/or the left or the right side surface of the air conditioner, and the outdoor air discharge port may be arranged on the left or the right side surface and/or the upper surface and/or the front end surface and/or the rear end surface of the air conditioner.

Figure 6:
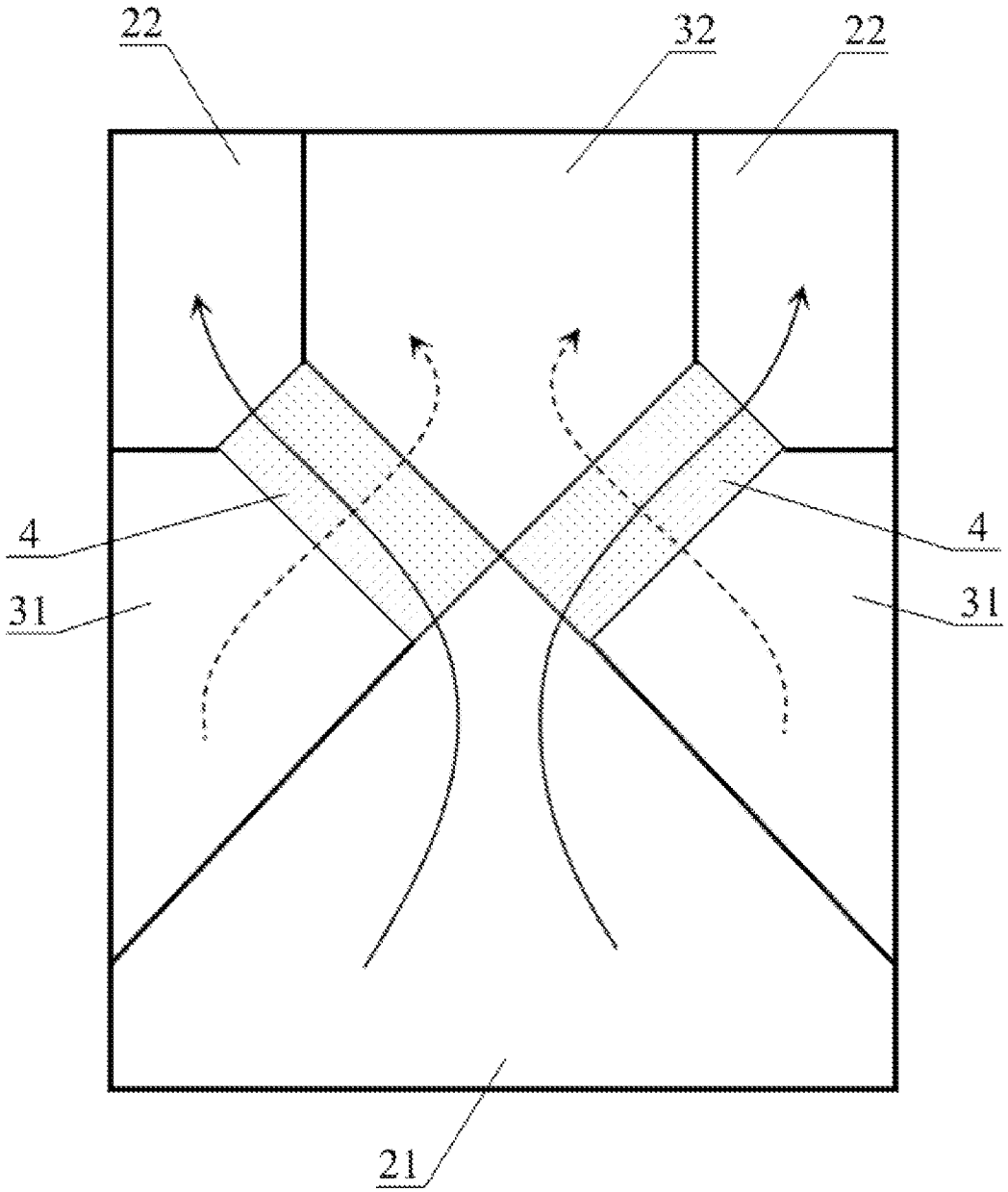
FIG. 6 is a schematic view showing a fourth airflow pattern in the indirect evaporative cooling air conditioner according to the specific embodiment of the present application.

As shown in FIG. 6, the indoor air returning port of the air conditioner may be arranged on the front end surface and/or the rear end surface and/or the left or the right side surface of the air conditioner, and the indoor air supply port may be arranged on the front end surface and/or the rear end surface and/or the upper surface of the air conditioner. The outdoor air introducing port may be arranged on the front end surface and/or the rear end surface and/or the lower surface and/or the left or the right side surface of the air conditioner, and the outdoor air discharge port may be arranged on the left or the right surface and/or the front end surface and/or the rear end surface and/or the upper surface of the air conditioner.

In the solutions of various airflow patterns in FIGS. 3 to 6, the at least two heat exchangers 4 may be designed to have different shapes, sizes, and mounting angles. In addition, the partition plates 5 may be designed in different forms. FIGS. 7 to 11 show some optional solutions.

It should be noted that, the housing 1 of the air conditioner according to the present application may be an one-piece housing, the one-piece housing, the at least two heat exchangers 4 and the multiple partition plates 5 which are arranged inside the housing 1 form an integrated unit. Alternatively, the housing 1 of the air conditioner may include multiple independent housings. That is, the air conditioner may be composed of only one unit, or formed by multiple independent units assembled together. As shown in FIG. 7, the housing 1 includes a first independent housing 11 and a second independent housing 12, one heat exchanger 4 and multiple partition plates 5 are provided inside each of the two independent housings. Each of the independent housings, the heat exchanger 4 and the multiple partition plates 5 which are arranged inside the independent housing form an independent unit, and the two independent units are assembled to form an indirect evaporative cooling air conditioner.

It should be noted that, in consideration of different sizes of the heat exchangers 4, two adjacent heat exchangers in the air conditioner may be directly connected or connected through a partition plate 5. Referring to FIG. 8, the sizes of two heat exchangers 4 in the air conditioner located at a left side of FIG. 8 is larger than the sizes of the two heat exchangers 4 in the air conditioner located at a right side of FIG. 8. In order to facilitate arrangement, the two heat exchangers 4 on the left side are directly connected, and the two heat exchangers 4 on the right side are connected through a partition plate 5.

It should be noted that, the multiple partition plates 5 in the air conditioner according to the present application may be made of a metallic material or a heat insulation material, which has a low thermal conductivity and sufficient strength, for example, a metal plate, a fire-proof insulation plate or a heat insulation plate.

Referring to FIG. 9, the at least two heat exchangers 4 according to the present application may be designed to have various sectional shapes, such as a triangle, a rectangle, a square, a quadrilateral, a pentagon or a hexagon. The airflow patterns in the six different arrangement structures of the heat exchanger shown in FIG. 9 are only for reference, and the specific airflow patterns are shown in FIGS. 3 to 6.

It should be noted that, the mounting angle of the heat exchanger 4 in the housing 1 may be any angle which is implementable, that is, the mounting angle of the heat exchanger 4 in the housing 1 ranges from 0 degree to 360 degrees. Six different mounting angles of the heat exchanger 4 are shown in FIG. 10. Taking an axis of symmetry of the housing 1 in FIG. 10 as a reference line, the mounting angle, which is embodied as an included angle between a side of the heat exchanger 4 and the reference line, may have many options. It should be noted that, when the mounting angle of the heat exchanger 4 in the housing 1 is changed, a sectional shape and a size of the outdoor air flow passage 2 and indoor air flow passage 3 which are adjacent to the heat exchanger 4 may change accordingly, as shown in FIG. 10. In consideration of this, those skilled in the art should determine the mounting angle of the heat exchanger 4 according to actual using requirements of the air conditioner.

It should be noted that, in order to realize the arrangement and airflow patterns of the heat exchanger according to the present application, the partition plates 5 configured to isolate the indoor side airflow from the outdoor side airflow can be designed to have different sizes, thicknesses, shapes and mounting angles. Specifically, the partition plate 5 may be designed as a straight plate arranged obliquely or vertically relative to, or in parallel with a side wall of the housing 1, or the partition plate 5 may be designed as a bent plate or a curved plate. FIG. 11 shows four different arrangement manners of the partition plate. In a sequence from left to right in FIG. 11, a first indicated partition plate 5 is a straight plate arranged to have an included angle of $\gamma$ relative to a side wall of the housing 1; a second indicated partition plate 5 is a straight plate arranged vertically relative to the side wall of the housing 1; the third indicated partition plate 5 is a straight plate arranged vertically relative to a bottom wall of the housing 1. Since the housing 1 in the figure is rectangular, the third indicated partition plate 5 is arranged parallel to the side wall of the housing 1. The fourth indicated partition plate 5 is a bent plate.

It should be noted that, in the indirect evaporative cooling air conditioner, in order to further improve the heat exchange efficiency, a spray member 6 configured to spray cooling water is further arranged in the outdoor air flow passage 2. Specifically, the spray member 6 may adopt a water sprayer or a mist sprayer or a combination of the water sprayer and the mist sprayer. The spray member 6 may be arranged in various manners in the outdoor air flow passage 2. FIG. 12 shows three feasible arrangement manners of the spray member 6 based on the airflow pattern in FIG. 2. Similarly, the spray member 6 may be arranged similar to FIG. 12 in the various airflow patterns in FIGS. 3 to 6, which is not repeated here.

In a preferred solution, the spray member 6 is a water sprayer, and the water sprayer is arranged in the outdoor air flow passage 2 located at an inlet side and/or an outlet side of the second heat exchange flow passage (that is, the water sprayer is arranged in the first outdoor air flow passage 21 and/or the second outdoor air flow passage 22). In another preferred solution, the spray member 6 is a mist sprayer, and the mist sprayer is arranged in the outdoor air flow passage 2 located at an inlet side of the second heat exchange flow passage (that is, the mist sprayer is arranged in the first outdoor air flow passage 21), and the water mist sprayed by the mist sprayer can be sprayed on the heat exchanger 4 under the action of the introduced outdoor air.

In the indirect evaporative cooling air conditioner, in a case that the outdoor temperature is high or the humidity is large, the indirect evaporative cooling efficiency is reduced. In order to meet the refrigeration capacity, the indirect evaporative cooling air conditioner provided according to the present application further includes a compression refrigeration cycle system, the compression refrigeration cycle system includes an evaporator 8 and a condenser 7, and the evaporator 8 and the condenser 7 may have different arrangement manners. The evaporator 8 is arranged in the indoor circulation passage and located downstream of the at least two heat exchangers 4 (that is, the second indoor air flow passage 32), to cool the fluid flowing out of the first heat exchange flow passages (that is, the indoor side airflow), so as to supplement the cooling capacity in a case that the indirect evaporative refrigeration capacity is insufficient. The condenser 7 is arranged in the outdoor circulation passage and located downstream of the at least two heat exchangers 4 (that is, the second outdoor air flow passage 22), to exchange heat with the fluid flowing out of the second heat exchange flow passage (that is, the outdoor side airflow). In this solution, the condenser 7 is arranged in the outdoor circulation passage, so as to cool a refrigerant in the condenser 7 by using the air flowing out of the outdoor circulation passage, to improve the condensation effect. FIG. 13 and FIG. 14 show three arrangement manners of the condenser 7 and the evaporator 8 respectively based on the airflow pattern in FIG. 2. Similarly, the above arrangement manners may be used in the airflow patterns in FIGS. 3 to 6, which is not repeated herein.

The present application has the following beneficial effects:

1. the flow passage design of the outdoor air flow passage 2 and the indoor air flow passage 3 is simple, and the local pressure loss is small;
2. the heat exchangers 4 arranged side by side have a large windward area, low air circulation resistance, and high heat exchange efficiency;
3. the outdoor air flow passage 2 and the indoor air flow passage 3 have sufficient space to arrange refrigeration members such as a fan, a condenser 7, an evaporator 8, a filter screen or a compressor, which can increase the windward area of the condenser 7 and the evaporator 8, and reduce the resistance of the system;
4. the space utilization is high; and
5. the energy efficiency ratio of the air conditioner is high.

Based on the above description of the disclosed embodiments, those skilled in the art are capable of carrying out or using the present application. It is obvious for those skilled in the art to make many modifications to these embodiments. The general principle defined herein may be applied to other embodiments without departing from the scope of the present application. Therefore, the present application is not limited to the embodiments illustrated herein, but should be defined by the broadest scope consistent with the principle and novel features disclosed herein.

The invention claimed is:

1. An indirect evaporative cooling air conditioner, comprising:

a housing;

a plurality of partition plates located in the housing; and at least two heat exchangers arranged side by side; wherein the plurality of partition plates and the at least two heat exchangers separate the housing into a plurality of indoor air flow passages and a plurality of outdoor air flow passages;

each of the at least two heat exchangers has a first heat exchange flow passage and a second heat exchange flow passage which are crosswise and independently arranged, the plurality of indoor air flow passages are in communication with the first heat exchange flow passage to form an indoor circulation passage, the plurality of outdoor air flow passages are in communication with the second heat exchange flow passage to form an outdoor circulation passage, and heat exchange between a fluid in the indoor circulation passage and a fluid in the outdoor circulation passage is performed by the at least two heat exchangers; wherein the plurality of outdoor air flow passages comprise a first outdoor air flow passage and a second outdoor air flow passage, the plurality of indoor air flow passages comprise a first indoor air flow passage and a second indoor air flow passage; the first outdoor air flow passage, the second outdoor air flow passage, the first indoor air flow passage and the second indoor air flow passage are distributed to peripherally surround the at least two heat exchangers; the first indoor air flow passage and the second indoor air flow passage are respectively in communication with inlets and outlets of the first heat exchange flow passages, and the first outdoor air flow passage and the second outdoor air flow passage are respectively in communication with inlets and outlets of the second heat exchange flow passages.

2. The indirect evaporative cooling air conditioner according to claim 1, wherein outlets or inlets of the first heat exchange passages of two adjacent heat exchangers of the at least two heat exchangers are in communication with a same indoor air flow passage of the plurality of indoor air flow passages, and inlets or outlets of the second heat exchange passages of the two adjacent heat exchangers are in communication with a same outdoor air flow passage of the plurality of outdoor air flow passages.

3. The indirect evaporative cooling air conditioner according to claim 1, wherein at least one of the plurality of outdoor air flow passages is provided with a spray member.

4. The indirect evaporative cooling air conditioner according to claim 3, wherein the spray member is a water sprayer, and the water sprayer is arranged in an outdoor air flow passage, located at an inlet side and/or an outlet side of the second heat exchange flow passage, of the plurality of outdoor air flow passages.

5. The indirect evaporative cooling air conditioner according to claim 3, wherein the spray member is a mist sprayer, and the mist sprayer is arranged in an outdoor air flow passage, located at an inlet side of the second heat exchange flow passage.

6. The indirect evaporative cooling air conditioner according to claim 1, further comprising a compression refrigeration cycle system, wherein the compression refrigeration cycle system comprises an evaporator, and the evaporator is arranged in the indoor circulation passage and located downstream of the at least two heat exchangers.

7. The indirect evaporative cooling air conditioner according to claim 1, further comprising a compression refrigeration cycle system, wherein the compression refrigeration cycle system comprises a condenser, and the condenser is arranged in the outdoor circulation passage and located downstream of the at least two heat exchangers.

8. The indirect evaporative cooling air conditioner according to claim 1, wherein the number of the at least two heat exchangers is two, the two heat exchangers, the plurality of indoor air flow passages and the plurality of outdoor air flow passages are respectively distributed in the housing in an axisymmetrical manner.

9. The indirect evaporative cooling air conditioner according to claim 1, wherein the housing is an one-piece housing, the one-piece housing, the at least two heat exchangers and the plurality of partition plates which are arranged inside the housing form an integrated unit; or, the housing comprises a plurality of independent housings, one of the at least two heat exchangers and a part of the plurality of partition plates are provided inside each of the plurality of independent housings, the independent housing, the heat exchanger and the part of the plurality of partition plates which are arranged inside the independent housing form an independent unit, and the indirect evaporative cooling air conditioner is formed by at least two independent units assembled to each other.

10. The indirect evaporative cooling air conditioner according to claim 1, wherein two adjacent heat exchangers of the at least two heat exchangers are directly connected or connected through one of the plurality of partition plates.

11. The indirect evaporative cooling air conditioner according to claim 1, wherein a sectional shape of each of the at least two heat exchangers is any one of a triangle, a quadrilateral, a pentagon, and a hexagon.

12. The indirect evaporative cooling air conditioner according to claim 1, wherein at least one of the plurality of partition plates is a straight plate arranged obliquely or vertically relative to, or in parallel with a side wall of the housing; or at least one of the plurality of partition plates is a bent plate.

13. The indirect evaporative cooling air conditioner according to claim 1, wherein a mounting angle of each of the at least two heat exchangers in the housing ranges from 0 degree to 360 degrees.

* * * * *